US006719529B2

(12) United States Patent
Tiemann

(10) Patent No.: US 6,719,529 B2
(45) Date of Patent: Apr. 13, 2004

(54) GAS TURBINE BLADE AND METHOD FOR PRODUCING A GAS TURBINE BLADE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 143 days.

(21) Appl. No.: 10/004,478

(22) Filed: Nov. 16, 2001

(65) Prior Publication Data

US 2002/0110454 A1 Aug. 15, 2002

(30) Foreign Application Priority Data

Nov. 16, 2000 (EP) ..... 00125031

(51) Int. Cl.[7] ..... F01D 5/08
(52) U.S. Cl. ..... 416/97 R; 415/115
(58) Field of Search ..... 415/115, 116, 415/96 R, 97 R; 416/97 R, 97 A, 96 R, 96 A, 95, 214 A, 193 A

(56) References Cited

U.S. PATENT DOCUMENTS 2,603,453 A * 7/1952 Sollinger
5,039,278 A * 8/1991 Wakeman et al. ..... 416/94
5,135,354 A * 8/1992 Novotny ..... 415/115
5,197,852 A * 3/1993 Walker et al. ..... 415/115
5,222,617 A 6/1993 Gregory et al.
5,800,124 A * 9/1998 Zelesky ..... 416/115
6,071,075 A * 6/2000 Tomita et al. ..... 416/97 R
6,082,961 A 7/2000 Anderson et al.
6,402,471 B1 * 6/2002 Demers et al. ..... 416/97 R
6,481,959 B1 * 11/2002 Morris et al. ..... 415/115

FOREIGN PATENT DOCUMENTS

| | | |
|---|---|---|
| DE | 26 28 807 A1 | 6/1976 |
| DE | 199 08 630 A1 | 8/2000 |
| EP | 0 615 055 A1 | 9/1994 |
| JP | 2000-141069 | 5/2000 |

* cited by examiner

*Primary Examiner*—Edward K. Look
*Assistant Examiner*—James M McAleenan
(74) *Attorney, Agent, or Firm*—Harness, Dickey & Pierce, P.L.C.

(57) ABSTRACT

A gas turbine blade includes an inlet edge region of a platform. Eroded into it is a slot which runs parallel to the flow-on edge and into which cooling air is introduced in an impact-cooled manner from the platform under side and is discharged in a film-cooling manner from the platform top side. This results in an efficient cooling system for the flow-on edge region of the platform. The method for producing a gas turbine blade includes producing ducts leading into the slot using laser drilling, the slot wall of the slot being protected by a Teflon strip.

15 Claims, 2 Drawing Sheets

GAS TURBINE BLADE AND METHOD FOR PRODUCING A GAS TURBINE BLADE

This application claims priority on European application number 00125031.5 filed Nov. 16, 2000 under 35 U.S.C. §119, the entire contents of which are hereby incorporated herein by reference in its entirety and for all purposes.

FIELD OF THE INVENTION

The invention generally relates to a gas turbine blade with a platform and with a profile adjoining the platform. The invention also generally relates to a method for producing a gas turbine blade.

BACKGROUND OF THE INVENTION

A gas turbine blade is disclosed in DE 26 28 807 A. Such a gas turbine blade is exposed to extremely high temperatures and therefore has to be cooled. The gas turbine blade has a platform serving for delimiting a flow duct, into which the gas turbine blade is installed. The platform has adjoining it, a profile which projects into the flow duct and around which the hot gas flows. The platform, too, is exposed to the hot gas. The platform is cooled using an impact-cooling system including an impact-cooling plate which is arranged on the underside of the platform and out of which cooling air flows onto the underside of the platform via impact-cooling orifices. This cooling air then emerges via film-cooling bores on the top side of the platform and forms a cooling film there.

SUMMARY OF THE INVENTION

An object of the invention is to specify a gas turbine blade, in which the platform withstands particularly high temperatures, with a comparatively small amount of cooling air being required. A further object of the invention is to specify a method for producing such a gas turbine blade.

According to the invention, the object directed at a gas turbine blade is achieved, for example, by specifying a gas turbine blade with a platform and with a profile adjoining a platform top side of the platform. The platform preferably includes a flow-on edge and a flow-off edge for a hot gas flowing around the gas turbine blade. Further, the platform preferably includes a slot which extends parallel to the inlet edge. Further, ducts are preferably introduced into the platform, which issue into the slot and which lead through the platform to a platform underside located opposite the platform top side.

The platform is preferably exposed to particularly high temperatures, in particular, at its flow-on (inlet) edge. The flow-on edge is that edge of the platform which is directed counter to the onflowing hot gas. This region of the platform can be cooled only with difficulty, since the profile located in front of it and a rounded and therefore thickened transitional region between the profile and the platform result in a geometry which is difficult to cool. By using the invention, it is now possible, in a simple way in manufacturing terms, to cool the platform flow-on edge efficiently. This is preferably carried out by cooling air being conducted from the platform underside through the ducts into the slot, where it cools the platform efficiently in the inlet-edge region. In this case, the wall formed between the slot and the inlet edge is preferably about 1–3 mm thick. This comparatively thin design results in good coolability, without load-bearing regions being adversely affected.

Preferably, the slot is inclined toward the profile in a direction from the platform underside to the platform top side, in such a way that a cooling fluid emerging from the slot brings about a film cooling of the platform top side. The slot is therefore tilted over its height in a direction from the flow-on (inlet) edge to the flow-off (outlet) edge. The inclination is in this case dimensioned such that cooling fluid, in particular cooling air, emerging under normal operating conditions sweeps along on the platform top side so as to form a film and thus has a film-cooling effect. After the cooling of the flow-on edge of the platform by the cooling fluid, the latter also serves subsequently for a film cooling of the platform top side.

Preferably, the ducts are directed in such a way that they issue into the slot in a direction toward the inlet edge. As a result, the cooling fluid emerging from the ducts is guided in an impact-cooling manner against that wall of the slot which is adjacent to the flow-on edge. This impact cooling gives rise to a particularly efficient cooling of the platform flow-on edge.

The gas turbine blade is preferably designed as a movable blade.

According to the invention, the object directed at a method is achieved, for example, by specifying a method for producing a gas turbine blade with a platform and with a profile adjoining a platform top side of the platform. The platform preferably includes a flow-on edge and a flow-off edge for a hot gas flowing around the gas turbine blade, wherein a slot which extends parallel to the inlet edge is introduced into the platform. Further, ducts are preferably introduced into the platform, which issue into the slot and which lead through the platform to a platform underside located opposite the platform top side.

The advantages of such a method are afforded correspondingly to the statements with regard to the advantages of the gas turbine blade.

The slot is preferably eroded into the platform.

Also preferably, the ducts are introduced into the platform by laser drilling. Preferentially, in this case, a light-scattering guard is mounted on that wall of the slot which is adjacent to the inlet edge prior to the completion of the laser drilling, so that this wall of the slot is not damaged by the laser radiation. More preferably, this light-scattering guard is a Teflon strip. In the particularly material-protecting and efficient manufacture of the ducts by laser drilling, there is initially the risk that, while the ducts are being drilled through, ultimately the wall of the slot which is adjacent to the inlet edge will be damaged by the laser radiation emerging from the ducts at the end of the manufacturing process. This is prevented by the light-scattering guard, in particular the mounting of the Teflon strip constituting a simple and quick method.

BRIEF DESCRIPTION OF THE DRAWINGS

The invention is explained in more detail in an exemplary embodiment by means of the drawing in which.

Identical reference symbols have the same significance in the figures.

DETAILED DESCRIPTION OF THE PREFERRED EMBODIMENTS

Figure 1:
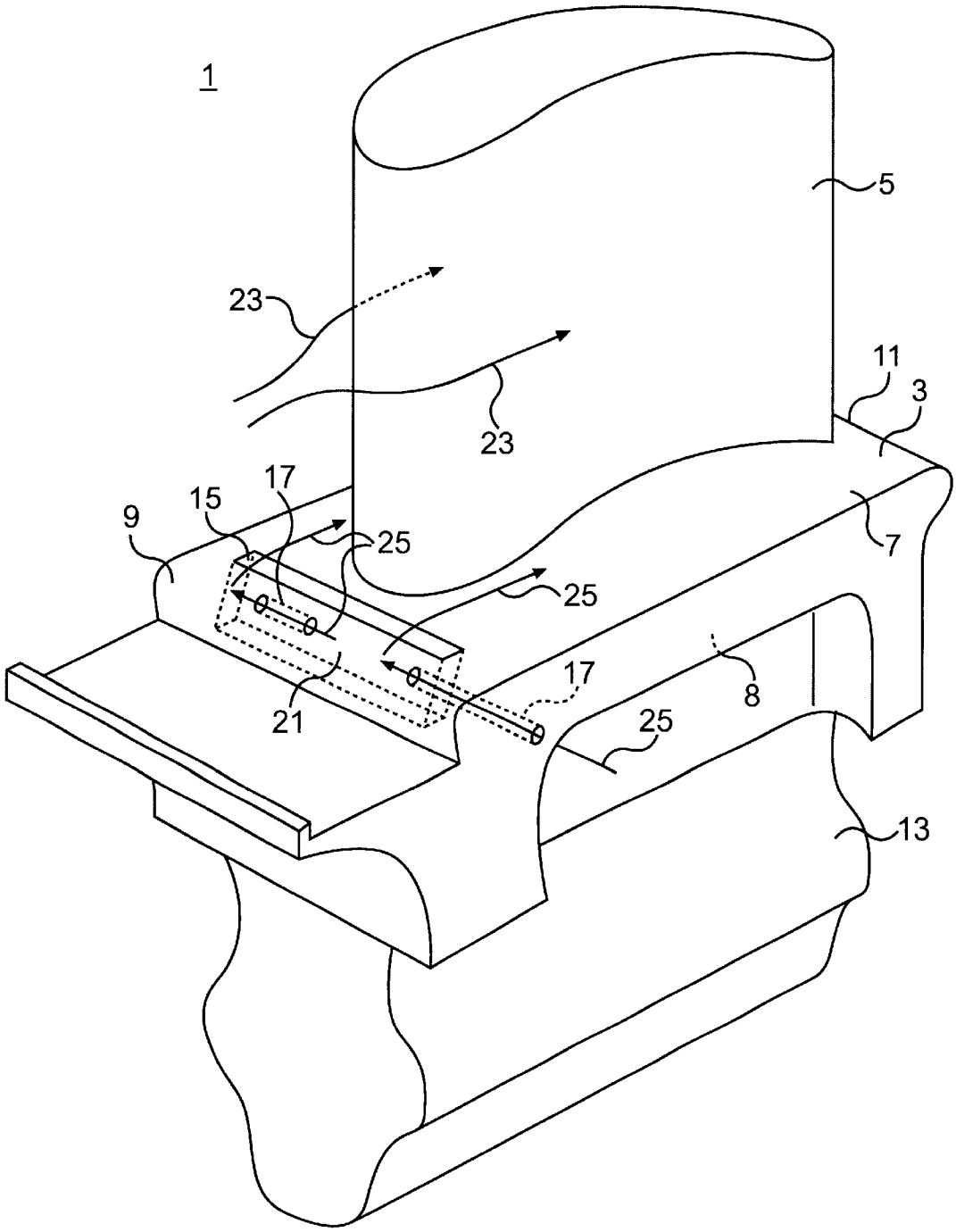
FIG. 1 shows a gas turbine blade.

FIG. 1 shows a gas turbine blade 1 which is designed as a moving blade. A profile 5 adjoins a platform 3. The platform 3 has a platform top side 7 which surrounds the profile 5. A platform underside 8 is located opposite the platform top side 7. The platform 3 has a flow-on edge 9 and a flow-off edge 11. The platform underside 8 has adjoining it a blade foot 13, by which the gas turbine blade 1 can be used with a rotor, not illustrated in any more detail, of a gas turbine.

Between the flow-on edge 9 and the profile 5, a slot 15 is eroded into the platform 3 so as to be parallel to the flow-on edge 9 and so as to open into the platform 3 onto the platform top side 7. The ducts 17 issue into this slot 15 and lead through the platform 3 from the platform underside 8 as far as the slot 15. The slot 15 is inclined in its height in a direction from the flow-on edge 9 to the flow-off edge 11. The ducts 17 lead approximately perpendicularly in the direction of that wall 21 of the slot 15 which is adjacent to the flow-on edge 9.

When the gas turbine blade 1 is being used, a hot gas 23 flows around the gas turbine blade 1. This results in the platform 3 and, in particular, the flow-on edge 9 being subjected to a high thermal load. Particularly effective cooling of the flow-on edge 9 is obtained by a cooling fluid 25, preferably cooling air, being routed out of the region below the platform 3 through the ducts 17 and into the slot 15. By virtue of the orientation of the ducts 17, of which more than the two ducts 17 shown may also be provided, the cooling fluid 25 is led perpendicularly onto the wall 21 of the slot 15. It thus cools the wall 21 and therefore efficiently cools the flow-on edge 9 by impact cooling. After a calming of the flow in the slot 15, then, as a result of the inclination of the slot, the cooling fluid 25 emerges from the latter in such a way that it flows off over the platform top side 7 so as to form a cooling film.

Figure 2:
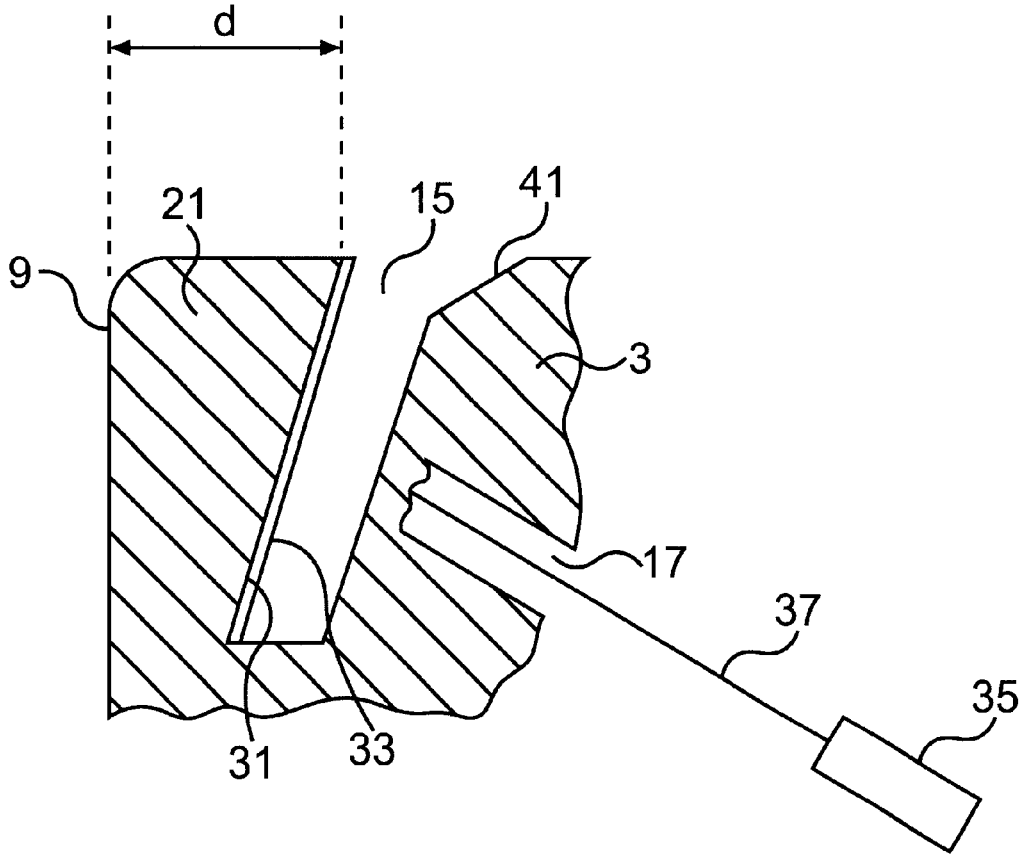
FIG. 2 shows a longitudinal section through the flow-on edge region of the platform of the gas turbine blade from FIG. 1.

A method for producing such a gas turbine blade 1 is illustrated in more detail in FIG. 2 which shows the flow-on edge region of the platform 3 in a longitudinal section. The wall 21 formed between the slot 15 and the flow-on edge 9 has a maximum thickness D of about 1–3 mm. That surface 31 of the wall 21 which lies in the slot 15 is provided with a Teflon strip 33 which serves as a light-scattering guard. This light-scattering guard 33 serves to protect against laser radiation 37 from a laser 35. Using this guard 33, the bores 17 are produced through laser drilling. The wall 21 is not damaged between the passage of the laser radiation 37 through the ready-drilled duct 17 since the Teflon strip 33 scatters this radiation 37.

To improve film cooling, the orifice of the slot 15 is preferably beveled with a bevel 41 in the direction of the profile 5.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A gas turbine blade comprising:

a platform portion; and a profile portion adjoining a top side of the platform portion, wherein the platform portion includes an inlet edge and an outlet edge for gas around the gas turbine blade, and wherein the platform portion includes a slot extending parallel to the inlet edge, the slot including at least one issue duct leading through the platform portion to an underside of the platform portion, located opposite of a top side of the platform portion, wherein a wall is formed between the slot and the inlet edge.

2. The gas turbine blade as claimed in claim 1, wherein the wall is about 0.53 mm thick.

3. The gas turbine blade of claim 1, wherein the wall is about 1–3 mm thick.

4. The gas turbine blade of claim 1, wherein the at least one duct is useable for conducting cooling air into the slot.

5. The gas turbine blade as claimed in claim 1, wherein the slot is inclined toward the profile portion in a direction from the platform portion underside to the platform portion top side, such that a cooling fluid emerging from the slot brings about a film cooling of the platform portion top side.

6. The gas turbine blade of claim 5, wherein the cooling fluid is cooling air.

7. The gas turbine blade as claimed in claim 1, wherein the at least one duct issues into the slot in a direction toward the inlet edge.

8. The gas turbine blade as claimed in claim 1, designed as a movable blade.

9. A gas turbine, including the gas turbine blade of claim 1.

10. The gas turbine blade of claim 1, wherein the at least one duct is useable for conducting cooling air into the slot.

11. A method for producing a gas turbine blade with a platform portion and with a profile portion adjoining a top side of the platform portion, the platform portion including an inlet edge and an outlet edge for gas around the gas turbine blade, comprising:

producing a slot, extending parallel to the inlet edge, in the platform portion, wherein a wall is formed between the slot and the inlet edge; and producing at least one duct in the platform portion, the at least one duct issuing into the slot and leading through the platform portion to an underside of the platform portion located opposite of a top side platform portion.

12. The method as claimed in claim 11, wherein producing the slot includes eroding the slot into the platform.

13. The method as claimed in claim 11, wherein the ducts are produced in the platform by laser drilling.

14. The method as claimed in claim 13, further comprising:

mounting a light-scattering guard on a wall of the slot which is adjacent to the inlet edge prior to the completion of the laser drilling, so that the wall of the slot is not damaged by laser radiation.

15. The method of claim 14, wherein the light scattering guard is a Teflon strip.

* * * * *